US007876313B2

(12) United States Patent
Selwan et al.

(10) Patent No.: US 7,876,313 B2
(45) Date of Patent: Jan. 25, 2011

(54) GRAPHICS CONTROLLER, DISPLAY CONTROLLER AND METHOD FOR COMPENSATING FOR LOW RESPONSE TIME IN DISPLAYS

(75) Inventors: Pierre Selwan, Fremont, CA (US); Maximino Vasquez, Fremont, CA (US)

(73) Assignee: Intel Corporation, Santa Clara, CA (US)

( * ) Notice: Subject to any disclaimer, the term of this patent is extended or adjusted under 35 U.S.C. 154(b) by 713 days.

(21) Appl. No.: 11/536,904

(22) Filed: Sep. 29, 2006

(65) Prior Publication Data

US 2008/0079735 A1 Apr. 3, 2008

(51) Int. Cl.
*G09G 5/00* (2006.01)

(52) U.S. Cl. ..... 345/204; 345/501

(58) Field of Classification Search ..... 345/204, 345/505, 60, 87, 88, 98, 501
See application file for complete search history.

(56) References Cited

U.S. PATENT DOCUMENTS

| | | | | |
|---|---|---|---|---|
| 5,418,572 | A * | 5/1995 | Nonweiler et al. | 348/446 |
| 5,872,588 | A * | 2/1999 | Aras et al. | 725/14 |
| 2003/0122809 | A1 | 7/2003 | Sakamaki et al. | |
| 2003/0142118 | A1 | 7/2003 | Funamoto et al. | |
| 2003/0179170 | A1* | 9/2003 | Lee | 345/87 |
| 2004/0119670 | A1 | 6/2004 | Rivera-Cintron et al. | |
| 2005/0140627 | A1 | 6/2005 | Moon et al. | |
| 2005/0253833 | A1* | 11/2005 | Teshirogi et al. | 345/204 |
| 2006/0132491 | A1* | 6/2006 | Riach et al. | 345/505 |
| 2006/0158416 | A1* | 7/2006 | Ku | 345/98 |
| 2007/0063940 | A1* | 3/2007 | Juenger | 345/87 |
| 2007/0146479 | A1* | 6/2007 | Huang et al. | 348/51 |
| 2007/0159425 | A1* | 7/2007 | Knepper et al. | 345/87 |
| 2008/0068318 | A1* | 3/2008 | Kerwin | 345/89 |
| 2008/0079739 | A1 | 4/2008 | Gupta et al. | |
| 2008/0231579 | A1* | 9/2008 | Vasquez et al. | 345/98 |

FOREIGN PATENT DOCUMENTS

| | | |
|---|---|---|
| CN | 1428762 | 7/2003 |
| CN | 1637845 | 7/2005 |

OTHER PUBLICATIONS

Gupta, A., et al., "Graphics Processor and Method for Controlling a Display Panel in Self-Refresh and Low-Response-Time Modes", U.S. Appl. No. 11/537,165, filed Sep. 29, 2006.

(Continued)

*Primary Examiner*—Amare Mengistu
*Assistant Examiner*—Dmitriy Bolotin
(74) *Attorney, Agent, or Firm*—Schwegman, Lundberg & Woessner, P.A.

(57) ABSTRACT

Embodiments of a graphics controller, display controller and method for compensating for low-response-time (LRT) displays are generally described herein. Other embodiments may be described and claimed. In some embodiments, an interleaved pixel stream is provided by a graphics controller to a display controller. The display controller may select low-response-time compensation for each pixel of the current frame based on the pixels of the current frame and corresponding pixels of the prior frame without the use of a frame buffer on a display panel.

14 Claims, 3 Drawing Sheets

OTHER PUBLICATIONS

"U.S. Appl. No. 11/537,165, Non Final Office Action mailed Jun. 12, 2009", 16 pgs.
"U.S. Appl. No. 11/537,165, Response filed Aug. 26, 2009 to Non Final Office Action mailed Jun. 12, 2009", 13 pgs.
200710192947.7, "Chinese application No. 200710192947.7 Office action mailed Jun. 19, 2009", 17 pgs.
200710199992.5, "Chinese application No. 200710199992.5 Office action mailed Jul. 10, 2009", 8 pgs.
"U.S. Appl. No. 11/537,165, Final Office Action mailed Dec. 14, 2009", 18 pgs.
"Taiwan Application Serial No. 96136388 ,Office Action mailed Nov. 11, 2010", 16 Pgs.

* cited by examiner

GRAPHICS CONTROLLER, DISPLAY CONTROLLER AND METHOD FOR COMPENSATING FOR LOW RESPONSE TIME IN DISPLAYS

TECHNICAL FIELD

The present invention pertains to graphics displays and graphics processing. Some embodiments relate to portable computers. Some embodiments relate to wireless communication devices.

BACKGROUND

Graphics displays, such as liquid-crystal displays (LCDs), are used for many different applications such as televisions, wireless telephones and notebook and portable computers. Due to the response time of the display elements, visual artifacts such as motion blur may occur when images with high-motion content are being displayed. Displays with faster response times exhibit fewer of these visual artifacts, but are generally more expensive. Compensation has been conventionally applied to less-expensive displays with lower response time elements to help reduce occurrence of these visual artifacts, but these techniques require memory, such as a frame buffer, increasing the cost of the display panel.

Thus, what are needed are graphics controllers, display panels and methods of compensating for the response time of display elements. What are also needed are graphics controllers, display panels and methods of compensating for the response time without additional memory on the display panel.

DETAILED DESCRIPTION

The following description and the drawings sufficiently illustrate specific embodiments of the invention to enable those skilled in the art to practice them. Other embodiments may incorporate structural, logical, electrical, process, and other changes. Portions and features of some embodiments may be included in, or substituted for, those of other embodiments. Embodiments of the invention set forth in the claims encompass all available equivalents of those claims. Embodiments of the invention may be referred to herein, individually or collectively, by the term "invention" merely for convenience and without intending to limit the scope of this application to any single invention or inventive concept if more than one is in fact disclosed.

Figure 1:
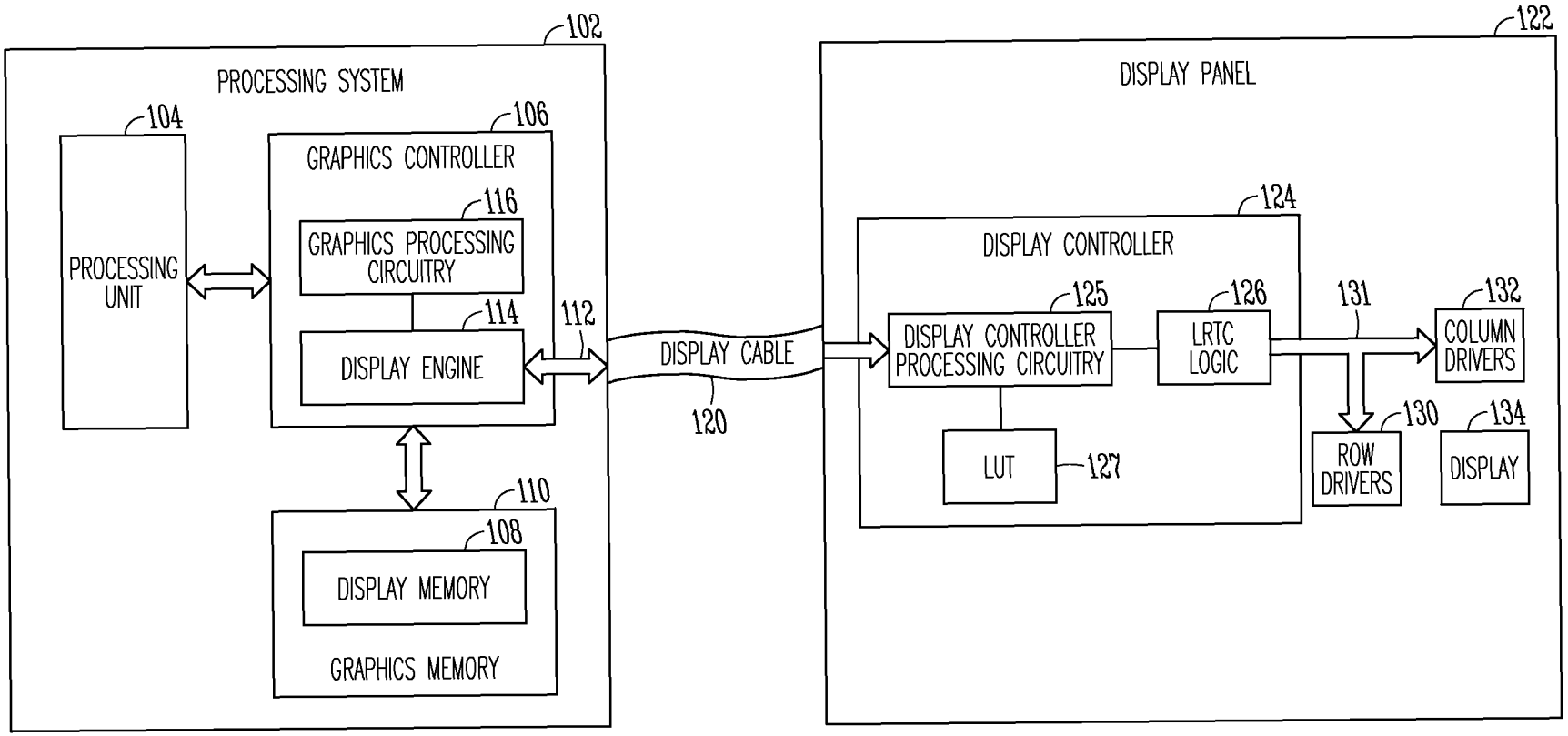
FIG. 1 illustrates a processing system and a display panel in accordance with some embodiments of the present invention.

FIG. 1 illustrates a processing system and a display panel in accordance with some embodiments of the present invention. Processing system 102 generates image data for display by display panel 122, among other things. Image data may include videos with high motion content. Processing system 102 includes processing unit 104, graphics controller 106 and graphics memory 110. As illustrated, processing system 102 and display panel 122 may be coupled by display cable 120. In some embodiments, processing system 102 and display panel 122 may be part of a portable computer, a video display device (e.g., a digital video disc (DVD) player), a digital camera with video capability, and/or a wireless communication device.

In some embodiments, graphics controller 106 may be a graphics chip, a graphics processing unit (GPU), or a Graphics and Memory Controller Hub (GMCH), although the scope of the invention is not limited in this respect. In some embodiments, graphics controller 106 may include graphics processing circuitry 116 to perform various processing operations for graphics controller 106, and display engine 114 for providing frames of pixels over interface 112 for display panel 122. Graphics controller 106 may also include clock-generating circuitry (not separately illustrated) to generate and/or provide clock signals and/or other timing signals for use within graphics controller 106. In some embodiments, display engine 114 may provide frames of pixels in a pixel stream manner to display panel 122.

In some embodiments, processing system 102 may comprise a motherboard of a personal computer, such as a portable or laptop computer. In some embodiments, processing unit 104 may comprise a microprocessor or a central processing unit (CPU) for processing system 102, although the scope of the invention is not limited in this respect.

Memory 110 may comprise random access memory (RAM), such as dynamic random access memory (DRAM), although other types of memory such as magnetic RAM (MRAM) may be suitable. Memory 110 may include display memory 108, discussed in more detail below.

Display panel 122 may comprise display controller 124 to control the operations of display panel 122 and receive frames of pixels as well as control signals from processing system 102. Display panel 122 may also include display 134, which may be a liquid crystal display (LCD). Display 134 may have drivers, such as row drivers 130 and column drivers 132, for providing signals to drive and/or control the individual elements of display 134.

Display controller 124 may include display controller processing circuitry 125 to perform various processing operations for display controller 124, discussed in more detail below. Display controller 124 may also include lower-response-time compensation (LRTC) logic 126 to provide compensated pixel values that may compensate for a slower response time of the elements of display 134. Display controller 124 may also include look-up-table (LUT) 127, which may be used in generating the compensated pixel values. These embodiments are discussed in more detail below. In some embodiments, display controller 124 may comprise a timing control chip or a timing controller (TCON), which may coordinate the operations on display panel 122. Display controller 124 may also include other functional elements and circuitry not separately illustrated.

Processing unit 104, among other things, may process commands that may instruct graphics controller 106 to render a new image. Graphics controller 106 may generate the image in the form of pixels or pixel values, which may be provided to display controller 124 through interface 112. Display controller 124 may convert the pixel values provided by graphics controller 106 into driver signals suitable for column drivers 132 and may instruct row drivers 130 when to address a row of display 134. In some embodiments, row drivers 130 may comprise gate drivers. In some embodiments, applications, as well as other processes (e.g., mouse movement) running on processing system 102, may cause processing unit 104 to generate new and/or updated images.

In accordance with some embodiments, display controller processing circuitry 125 receives an interleaved pixel stream from graphics controller 106. The interleaved pixel stream may comprise pixels of a current frame interleaved with pixels of a prior frame. In these embodiments, display controller processing circuitry 125 selects low-response-time (LRT) compensation for each pixel of the current frame based on the values of pixels of the current frame and corresponding pixels of the prior frame. LRTC logic 126 may apply the LRT compensation to the pixels of the current frame to generate compensated pixel values 131 for column drivers 132 of display 134. Accordingly, LRT compensation may be performed by display panel 122 without the use of a frame buffer on display panel 122. In some embodiments, the interleaved pixel stream may comprise a pixel of the current frame followed by a corresponding pixel of the prior frame, although the scope of the invention is not limited in this respect as other types of pixel interleaving are suitable. In some embodiments, LUT 127 may store the LRT compensation values selected by LRTC logic 126. The selected LRT compensation values may reduce the occurrence of motion artifacts resulting from a slower response time of elements of display 134.

In some embodiments, the compensated pixel values may cause column drivers 132 to either overdrive or under-drive elements of display 134. The LRT compensation may be based on a response time of the display elements to achieve a desired luminance response.

In some embodiments, display controller processing circuitry 125 may apply gamma correction to pixels of the current frame prior to LRTC logic 126 applying the LRT compensation. In some alternate embodiments, display controller processing circuitry 125 may apply gamma correction to pixels of the current frame after LRTC logic 126 applies the LRT compensation, although the scope of the invention is not limited in this respect.

In some embodiments, display controller processing circuitry 125 may be responsive to a mode control signal provided by graphics controller 106 indicating whether an interleaved pixel stream or a non-interleaved pixel stream will be provided. In these embodiments, the non-interleaved pixel stream may comprise pixels of a current frame without pixels of a prior frame.

In some embodiments, the mode control signal may be an out-of-band signal provided, for example, during a vertical-blanking interval (VBI). In some other embodiments, the mode control signal may be an in-band signal, although the scope of the invention is not limited in this respect.

In some embodiments, when the mode control signal indicates that a non-interleaved pixel stream will be provided, display controller processing circuitry 125 either instructs LRTC logic 126 to refrain from applying LRT compensation to the pixel values of the current frame, or bypasses LRTC logic 126. Accordingly, when the image is static, no LRT compensation is required and graphics controller 106 may send only the pixels of the current frame. In some other embodiments, graphics controller 106 may send an interleaved pixel stream regardless of whether the image is static or moving.

In some embodiments, when the mode control signal indicates that a non-interleaved pixel stream will be provided, display controller 124 may receive frame data from graphics controller 106 at a frame-refresh pixel rate. When the mode control signal indicates that an interleaved pixel stream will be provided, display controller 124 may receive frame data from graphics controller 106 at twice the frame-refresh pixel rate, although the scope of the invention is not limited in this respect. In these embodiments, the frame-refresh rate may remain the same, but the amount of pixel data within each frame may double, resulting in twice the data rate (i.e., twice the frame-refresh pixel rate). In some embodiments, the data may be compressed to provide for a lower data rate.

In some embodiments, the response time of the elements of display 134 may range from 25 to 40 milliseconds (ms). In these embodiments, the rate at which display 134 is refreshed (i.e., frame-refresh pixel rate) may be about 60 Hertz, which is a 16.6 ms frame interval. Without LRT compensation, the difference between the frame-refresh pixel rate and the response time of the display elements may result in the presence of artifacts (e.g., blurring) on display 134.

In some embodiments, display controller 124 may refrain from buffering pixels of a prior frame, whether the pixels of the prior frame are received as part of the interleaved pixel stream, or whether the pixels of the prior frame were the current pixels of last frame. In this way, display panel 122 does not need a frame buffer to store pixels of the prior frame to provide LRT compensation.

In these embodiments, a register may be used to hold a number of pixels depending on the interleaving. For example, when the pixels of the current frame are interleaved on a pixel-by-pixel basis with pixels of a prior frame, the register may hold a single pixel. In other embodiments, when more than one pixel of the current frame is provided and interleaved with other pixels on a group-by-group basis (e.g., group interleaving) or a line-by-line basis (e.g., line interleaving), the register may hold a group or a line of pixels of the prior frame.

In some embodiments, display engine 114 may provide a non-interleaved pixel stream to display controller 124 in idle mode when pixel values do not change between the current frame and a predetermined number of prior frames. In these embodiments, display engine 114 may provide an interleaved pixel stream to display controller 124 in non-idle mode when one or more pixel values change between the current frame and the prior frame. In some embodiments, graphics controller 106 may instruct display controller 124 to remain in non-idle mode during video playback operations.

In accordance with some embodiments, graphics processing circuitry 116 may generate the interleaved pixel stream and display engine 114 may provide the interleaved pixel stream to display controller 124. Display controller 124 may select LRT compensation for each pixel of the current frame based on the pixels of the current frame and corresponding pixels of the prior frame without the use of a frame buffer on display panel 122.

In some embodiments, graphics processing circuitry 116 generates a mode control signal for display controller 124, indicating that a non-interleaved pixel stream will be provided. In these embodiments, graphics processing circuitry 116 may generate the mode control signal when pixel values do not change between the current frame and a predetermined number of one or more prior frames. After providing the mode control signal to display controller 124, graphics processing circuitry 116 may generate a non-interleaved pixel stream for display controller 124. In response to receipt of the mode control signal, display controller 124 may refrain from selecting and applying LRT compensation to pixels of current frames.

In some embodiments, graphics processing circuitry 116 may generate a mode control signal for display controller 124, indicating that an interleaved pixel stream will be provided. In these embodiments, graphics processing circuitry 116 may generate the mode control signal when pixel values change between a current frame and a prior frame. After providing this mode control signal to display controller 124, graphics processing circuitry 116 may generate the interleaved pixel stream comprising pixels of a current frame with pixels of a prior frame. In response to receipt of this mode control signal, display controller 124 may apply LRT compensation to pixels of current frames.

In some embodiments, display engine 114 may provide the non-interleaved pixel stream a frame-refresh pixel rate, and may provide the interleaved pixel stream at twice the frame-refresh pixel rate (i.e., the same frame-refresh rate, but at twice the data rate), although the scope of the invention is not limited in this respect. In some embodiments, graphics processing circuitry 116 may store or buffer pixels of the prior frame in display memory 108. Graphics processing circuitry 116 may retrieve the stored pixels of the prior frame from display memory 108 for use in generating the interleaved pixel stream. In some embodiments, graphics processing circuitry 116 may compare pixels of a current frame with the buffered pixels of a prior frame to determine whether or not to provide a mode control signal.

Although processing system 102 and display panel 122 are illustrated as having several separate functional elements, one or more of the functional elements may be combined and may be implemented by combinations of software-configured elements, such as processing elements including digital signal processors (DSPs), and/or other hardware elements. For example, some elements may comprise one or more microprocessors, DSPs, application specific integrated circuits (ASICs), and combinations of various hardware and logic circuitry for performing at least the functions described herein. In some embodiments, the functional elements of processing system 102 and display panel 122 may refer to one or more processes operating on one or more processing elements.

Figure 2:
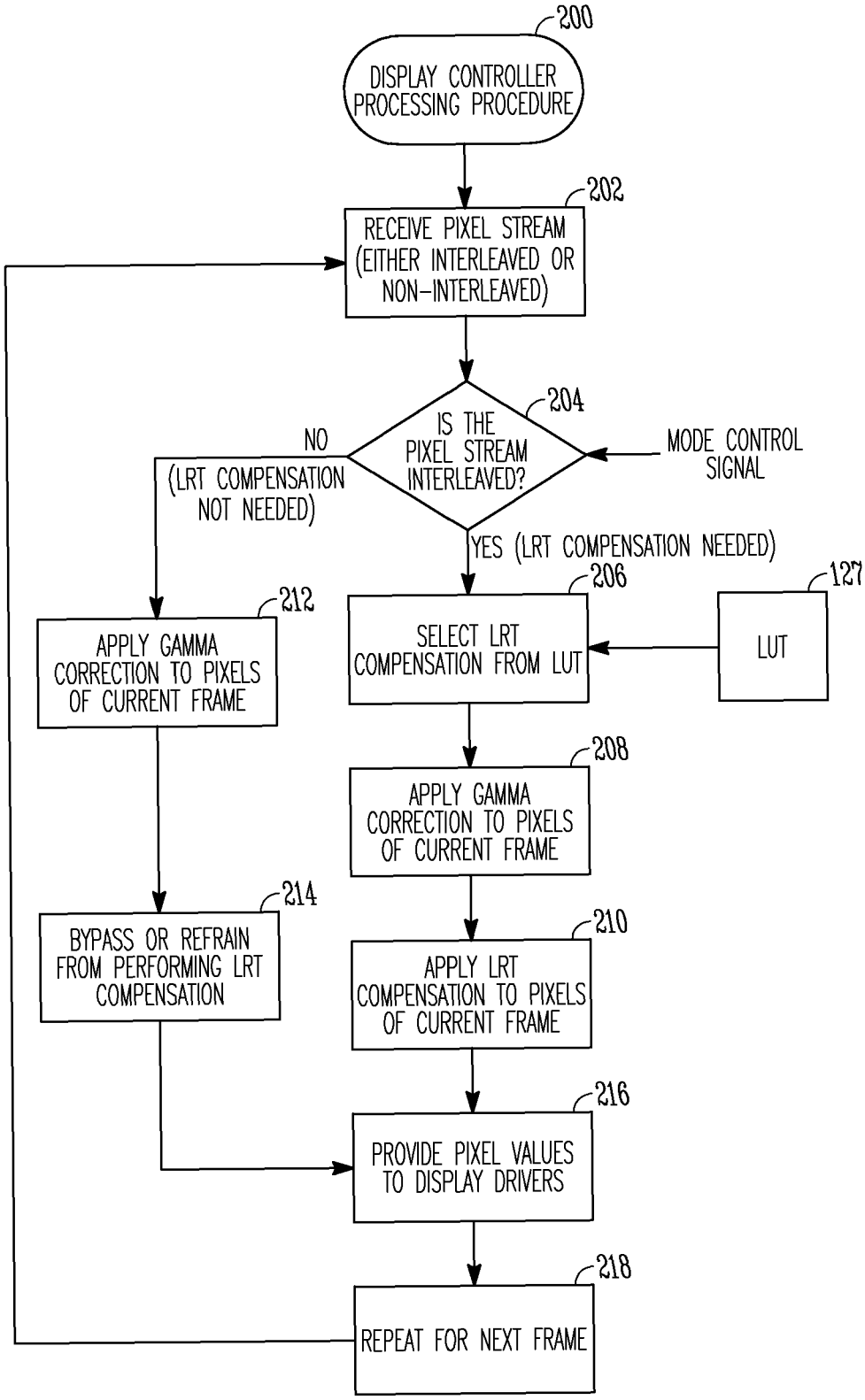
FIG. 2 is a flow chart of a display controller processing procedure in accordance with some embodiments of the present invention.

FIG. 2 is a flow chart of a display controller processing procedure in accordance with some embodiments of the present invention. Display controller processing procedure 200 may be performed by a display controller, such as display controller 124 (FIG. 1), although other circuitry may be used to perform procedure 200.

In operation 202, a pixel stream may be received from a graphics controller, such as graphics controller 106 (FIG. 1). The pixel stream may comprise either an interleaved pixel stream or a non-interleaved pixel stream, as discussed above. In some embodiments, prior to the receipt of the pixel stream, the display controller may have been instructed as to whether the pixel stream is an interleaved pixel stream or a non-interleaved pixel stream. In some other embodiments, the display controller may initially assume that the pixel stream is one of either an interleaved pixel stream or a non-interleaved pixel stream until a mode control signal is received from the graphics controller.

In operation 204, the display controller continues to receive the pixel stream. When the pixel stream is interleaved, operations 206 through 210 are performed. When the pixel stream is non-interleaved, operations 212 and 214 are performed.

In some embodiments, as part of operation 204, a mode control signal may be received from the graphics controller, indicating whether an interleaved or non-interleaved pixel stream is going to be provided. When the mode control signal indicates that an interleaved pixel stream is going to be provided, operations 206 through 210 are performed. When the mode control signal indicates that a non-interleaved pixel stream is going to be provided, operations 212 and 214 are performed.

In operation 206, the processing circuitry of the display controller may select LRT compensation from a LUT, such as LUT 127.

In operation 208, the processing circuitry of the display controller may apply gamma correction to the pixels of the current frame.

In operation 210, the LRT compensation logic of the display controller may apply the LRT compensation that was selected in operation 206 to pixels of the current frame. In these embodiments, the gamma correction of operation 208 may be applied prior to applying the LRT compensation. In some other embodiments, gamma correction may be applied after LRT compensation, however different LRT compensation values would be used.

In operation 212, the processing circuitry of the display controller may apply gamma correction to the pixels of the current frame that were received as part of a non-interleaved pixel stream.

In operation 214, the processing circuitry of the display controller may instruct LRT compensation logic to refrain from performing LRT compensation on the pixels of the current frame. In some embodiments, the processing circuitry of the display controller may bypass the LRT compensation logic, although the scope of the invention is not limited in this respect.

In operation 216, the pixel values of the current frame are provided to the display drivers. The pixel values may have LRT compensation and/or gamma correction applied as discussed above.

In operation 218, operations 202 through 216 may be repeated for pixels of the next frame received from the graphics controller. Although procedure 200 may allow the display controller to switch between modes on a frame by frame basis, in some embodiments, the display controller may remain in LRT compensation mode for at least a predetermined number of frames or a predetermined time period.

Although the individual operations of procedure 200 are illustrated and described as separate operations, one or more of the individual operations may be performed concurrently, and nothing requires that the operations be performed in the order illustrated.

Figure 3:
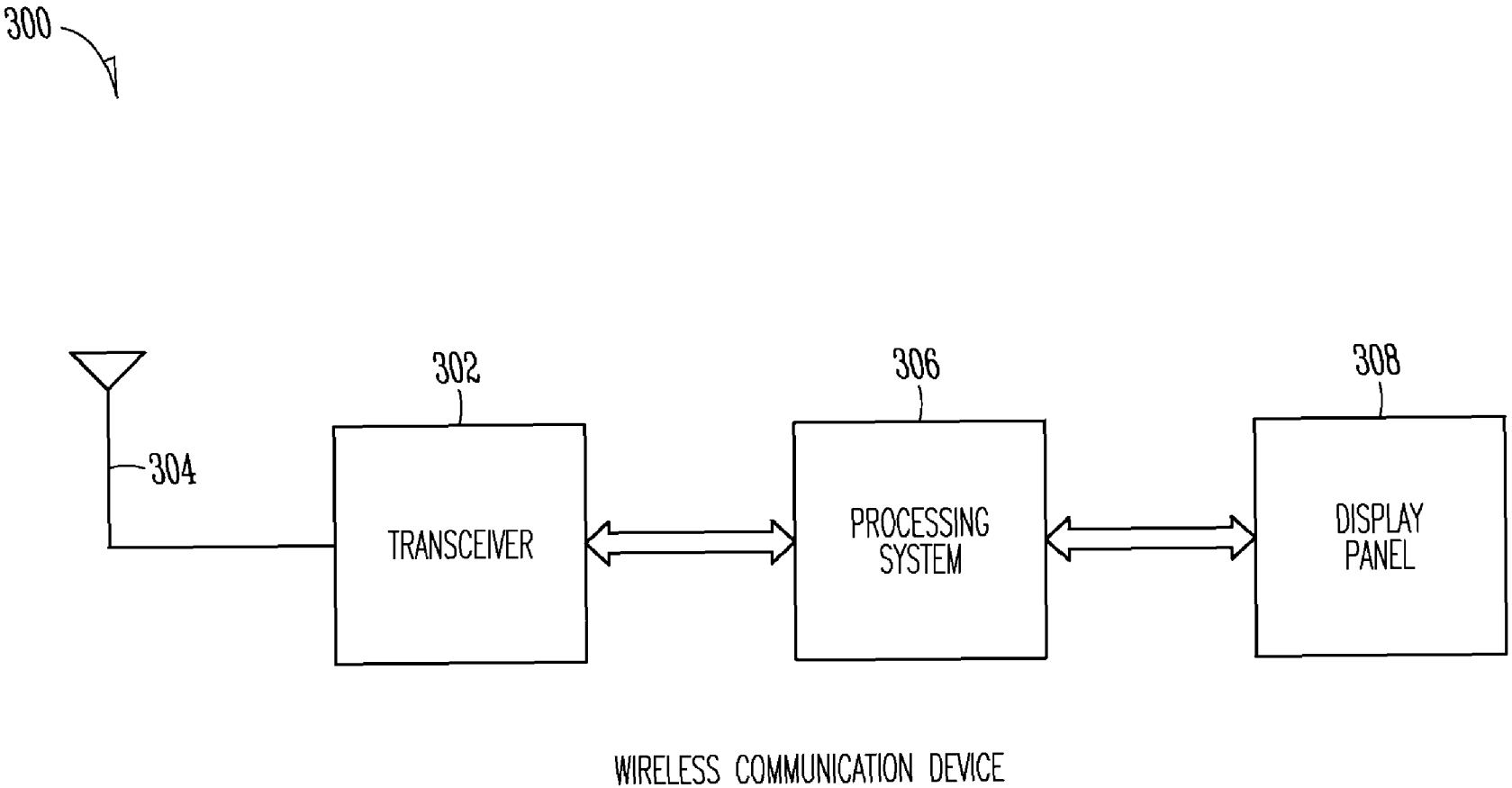
FIG. 3 illustrates a wireless communication device in accordance with some embodiments of the present invention.

FIG. 3 illustrates a wireless communication device in accordance with some embodiments of the present invention. Wireless communication device 300 includes transceiver 302 for communicating radio-frequency (RF) signals with other wireless communication devices using antenna 304. Wireless communication device 300 also includes processing system 306 for providing signals to transceiver 302 for transmission, and for processing signals received by transceiver 302. Wireless communication device 300 also includes display panel 308 for displaying images, including high-motion video content, in accordance with image data and control signals from processing system 306. In some embodiments, the image data may be received through antenna 304. In other embodiments, wireless communication device 300 may include a digital camera, and the image data may be generated by digital image capturing circuitry within the wireless communication device. In these embodiments, the image data may be displayed by display panel 308 and/or transmitted using transceiver 302, although the scope of the invention is not limited in this respect. In some embodiments, processing system 306 may correspond to processing system 102 (FIG. 1) and display panel 308 may correspond to display panel 122 (FIG. 1).

Wireless communication device 300 may be almost any portable wireless communication device, such as a personal digital assistant (PDA), a laptop or portable computer with wireless communication capability, a web tablet, a wireless telephone, a wireless headset, a pager, an instant messaging device, a digital camera, an access point, a television, a medical device (e.g., a heart rate monitor, a blood pressure monitor, etc.), or other device that may receive and/or transmit information wirelessly.

In some embodiments, transceiver 302 may communicate using orthogonal frequency division multiplexed (OFDM) communication signals over a multicarrier communication channel. In some embodiments, transceiver 302 may communicate using orthogonal frequency division multiple access (OFDMA) communication signals. In some embodiments, transceiver 302 may communicate using spread-spectrum signals, although the scope of the invention is not limited in this respect.

In some embodiments, wireless communication device 300 may be part of a communication station, such as wireless local area network (WLAN) communication station including a Wireless Fidelity (WiFi) communication station, an access point (AP) or a mobile station (MS). In some other embodiments, wireless communication device 300 may be part of a broadband wireless access (BWA) network communication station, such as a Worldwide Interoperability for Microwave Access (WiMax) communication station, although the scope of the invention is not limited in this respect as wireless communication device 300 may be part of almost any wireless communication device.

In some embodiments, the frequency spectrums for the communication signals transmitted and received by wireless communication device 300 may comprise frequencies between 2 and 11 GHz, although the scope of the invention is not limited in this respect.

Antenna 304 may comprise one or more directional or omnidirectional antennas, including, for example, dipole antennas, monopole antennas, patch antennas, loop antennas, microstrip antennas or other types of antennas suitable for transmission of RF signals. In some multiple-input, multiple-output (MIMO) embodiments, two or more antennas may be used.

Unless specifically stated otherwise, terms such as processing, computing, calculating, determining, displaying, or the like, may refer to an action and/or process of one or more processing or computing systems or similar devices that may manipulate and transform data represented as physical (e.g., electronic) quantities within a processing system's registers and memory into other data similarly represented as physical quantities within the processing system's registers or memories, or other such information storage, transmission or display devices. Furthermore, as used herein, a computing device includes one or more processing elements coupled with computer-readable memory that may be volatile or non-volatile memory or a combination thereof.

Some embodiments of the invention may be implemented in one or a combination of hardware, firmware and software. Some embodiments of the invention may also be implemented as instructions stored on a machine-readable medium, which may be read and executed by at least one processor to perform the operations described herein. A machine-readable medium may include any mechanism for storing or transmitting information in a form readable by a machine (e.g., a computer). For example, a machine-readable medium may include read-only memory (ROM), random-access memory (RAM), magnetic disk storage media, optical storage media, flash-memory devices, electrical, optical, acoustical or other form of propagated signals (e.g., carrier waves, infrared signals, digital signals, etc.), and others.

In some embodiments, the present invention provides a method comprising generating an interleaved pixel stream comprising pixels of a current frame interleaved with pixels of a prior frame, and providing the interleaved pixel stream to display controller 124 (FIG. 1), wherein display controller 124 (FIG. 1) selects low-response-time (LRT) compensation for each pixel of the current frame based on the pixels of the current frame and corresponding pixels of the prior frame without the use of a frame buffer on a display panel. The method may further comprise generating a first mode control signal for display controller 124 (FIG. 1) indicating that a non-interleaved pixel stream will be provided. The first mode control signal may be generated when pixel values do not change between the current frame and a predetermined number of one or more prior frames. After providing the mode control signal to display controller 124 (FIG. 1), the method may further comprise generating the non-interleaved pixel stream for display controller 124 (FIG. 1). In some embodiments, the method may also comprise generating a second mode control signal for display controller 124 (FIG. 1) indicating that an interleaved pixel stream will be provided. The second mode control signal may be generated when pixel values change between a current frame and a prior frame. After providing the second mode control signal to display controller 124 (FIG. 1), the method further comprises generating the interleaved pixel stream comprising pixels of a current frame with pixels of a prior frame. In response to receipt of the second mode control signal, display controller 124 (FIG. 1) may apply LRT compensation to pixels of current frames.

Some embodiments of the present invention are directed to a portable computer system comprising graphics controller 106 to generate an interleaved pixel stream, and display controller 124 (FIG. 1) to receive the interleaved pixel stream and to select low-response-time (LRT) compensation for each pixel of the current frame based on the pixels of the current frame and corresponding pixels of the prior frame.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims.

In the foregoing detailed description, various features are occasionally grouped together in a single embodiment for the purpose of streamlining the disclosure. This method of disclosure is not to be interpreted as reflecting an intention that the claimed embodiments of the subject matter require more features than are expressly recited in each claim. Rather, as the following claims reflect, invention may lie in less than all features of a single disclosed embodiment. Thus, the following claims are hereby incorporated into the detailed description, with each claim standing on its own as a separate preferred embodiment.

What is claimed is:

1. A display controller configured for use within a display panel, the display controller comprising:

low response-time (LRT) compensation logic; and processing circuitry to receive either an interleaved pixel stream or a non-interleaved pixel stream from a graphics controller, the interleaved pixel stream comprising pixels of a current frame interleaved with pixels of a prior frame, the interleaved pixel stream provided over a display cable from the graphics controller to the display controller, the non-interleaved pixel stream comprising pixels of a current frame without pixels of a prior frame, wherein when an interleaved pixel stream is received, the processing circuitry is to instruct the LRT compensation logic to apply LRT compensation for each pixel of the current frame based on values of pixels of the current frame and corresponding pixels of the prior frame, wherein when a non-interleaved pixel stream is received, the processing circuitry is either to instruct the LRT compensation logic to refrain from applying LRT compensation to the pixel values of the current frame or to bypass the LRT compensation logic, wherein the LRT compensation logic is to generate compensated pixel values for a display, wherein when a non-interleaved pixel stream is received, the display controller is to receive pixels of the non-interleaved pixel stream from the graphics controller at a frame-refresh pixel rate, wherein when an interleaved pixel stream is received, the display controller is to receive pixels of the interleaved pixel stream at twice the frame-refresh pixel rate, and wherein receiving the interleaved pixel stream over the display cable allows the display controller to operate without a need for a frame buffer to buffer pixels of prior frames when LRT compensation is applied.

2. The display controller of claim 1 wherein the interleaved pixel stream comprises a pixel stream in which a pixel of the current frame is followed by a corresponding pixel of the prior frame provided over the display cable.

3. The display controller of claim 2 wherein the compensated pixel values either overdrive or under-drive elements of the display, wherein the LRT compensation is based on a response time of elements of the display to achieve a desired luminance response, and wherein the processing circuitry applies gamma correction to pixels of the current frame prior to the LRT compensation logic applying the LRT compensation.

4. The display controller of claim 3 wherein the processing circuitry is responsive to a mode control signal provided by the graphics controller indicating whether an interleaved pixel stream or a non-interleaved pixel stream will be provided, wherein when the mode control signal indicates that a non-interleaved pixel stream will be provided, the processing circuitry either instructs the LRT compensation logic to refrain from applying LRT compensation to the pixel values of the current frame or bypasses the LRT compensation logic.

5. The display controller of claim 4 wherein the mode control signal is an out of band signal provided during a vertical-blanking interval.

6. The display controller of claim 4 wherein a display engine provides the non-interleaved pixel stream to the display controller when pixel values do not change between the current frame and a predetermined number of prior frames, and wherein the display engine provides the interleaved pixel stream to the display controller when one or more pixel values change between the current frame and the prior frame.

7. A graphics controller comprising:

processing circuitry to generate either an interleaved pixel stream or a non-interleaved pixel stream, the interleaved pixel stream comprising pixels of a current frame interleaved with pixels of a prior frame, the non-interleaved pixel stream comprising pixels of a current frame without pixels of a prior frame; and a display engine to provide either the interleaved pixel stream or the non-interleaved pixel stream to a display controller, the interleaved pixel stream being provided over a display cable from the display engine to the graphics controller, wherein when the interleaved pixel stream is provided, the display controller is to select low-response-time (LRT) compensation for each pixel of the current frame based on the pixels of the current frame and corresponding pixels of the prior frame, wherein when the non-interleaved pixel stream is provided, the display controller is to refrain from selecting the LRT compensation, wherein when a non-interleaved pixel stream is provided, the display engine is to provide pixels of the non-interleaved pixel stream to the display controller at a frame-refresh pixel rate, wherein when an interleaved pixel stream is provided, the display engine is to provide pixels of the interleaved pixel stream to the display controller at twice the frame-refresh pixel rate, and wherein by providing the interleaved pixel stream over the display cable, the display controller is configured operate without a need for a frame buffer to buffer pixels of prior frames when LRT compensation is applied.

8. The graphics controller of claim 7 wherein the interleaved pixel stream comprises a single pixel stream in which a pixel of the current frame is followed by a corresponding pixel of the prior frame provided over the display cable.

9. The graphics controller of claim 8 wherein the processing circuitry is to generate a first mode control signal for the display controller indicating that a non-interleaved pixel stream will be provided, the first mode control signal being generated when pixel values do not change between the current frame and a predetermined number of one or more prior frames, wherein after providing the first mode control signal to the display controller, the processing circuitry is to generate the non-interleaved pixel stream for the display controller, wherein in response to receipt of the first mode control signal, the display controller is to refrain from applying LRT compensation to pixels of current frames, wherein the processing circuitry is to generate a second mode control signal for the display controller indicating that an interleaved pixel stream will be provided, the second mode control signal generated when pixel values change between a current frame and a prior frame, wherein after providing the second mode control signal to the display controller, the processing circuitry is to generate the interleaved pixel stream comprising pixels of a current frame with pixels of a prior frame, and wherein in response to receipt of the second mode control signal, the display controller is to apply LRT compensation to pixels of current frames.

10. The graphics controller of claim 7 wherein the processing circuitry is to store pixels of the prior frame in a display memory coupled to the graphics controller, and wherein the processing circuitry is to retrieve the stored pixels of the prior frame from the display memory for use in generating the interleaved pixel stream.

11. A method performed by a display controller comprising:

receiving either an interleaved pixel stream comprising pixels of a current frame interleaved with pixels of a prior frame or a non-interleaved pixel stream comprising pixels of a current frame without pixels of a prior frame from a graphics controller, the interleaved pixel stream being received over a display cable from the graphics controller to the display controller;

when the interleaved pixel stream is received, the method comprises:

selecting low-response-time (LRT) compensation for each pixel of the current frame based on values of pixels of the current frame and corresponding pixels of the prior frame; and applying the LRT compensation to the pixels of the current frame to generate compensated pixel values for a display, wherein when the non-interleaved pixel stream is received, the method comprises refraining from selecting LRT compensation for the pixel values of the current frame, wherein when a non-interleaved pixel stream is received, pixels of the non-interleaved pixel stream are received from the graphics controller at a frame-refresh pixel rate, and wherein when an interleaved pixel stream is received, pixels of the interleaved pixel stream are received at twice the frame-refresh pixel rate, and wherein receiving the interleaved pixel stream over the display cable allows the display controller to operate without a need for a frame buffer to buffer pixels of prior frames when LRT compensation is applied.

12. The method of claim 11 wherein the interleaved pixel stream comprises a single pixel stream in which a pixel of the current frame is followed by a corresponding pixel of the prior frame provided over the display cable.

13. The method of claim 12 wherein the compensated pixel values either overdrive or under-drive elements of the display, wherein the LRT compensation is based on a response time of elements of the display to achieve a desired luminance response.

14. The method of claim 13 further comprising applying gamma correction to pixels of the current frame prior to applying the LRT compensation.

* * * * *